United States Patent [19]

Conroy

[11] 4,192,434

[45] Mar. 11, 1980

[54] CONTAINER CLOSURE ASSEMBLY

[75] Inventor: Michael F. Conroy, Bridgeville, Pa.

[73] Assignee: Federal Paper Board Company, Inc., Montvale, N.J.

[21] Appl. No.: 933,147

[22] Filed: Aug. 14, 1978

[51] Int. Cl.[2] ..... B65D 5/64; B65D 43/00

[52] U.S. Cl. ..... 220/306; 229/21; 229/43

[58] Field of Search ..... 220/306, 304, 254, 90; 229/21, 5.5, 43

[56] References Cited

U.S. PATENT DOCUMENTS

| | | | |
|---|---|---|---|
| 2,873,052 | 2/1959 | Atherton | 220/90 X |
| 2,909,228 | 10/1959 | Connors | 220/307 X |
| 2,990,998 | 7/1961 | Barclay | 229/43 |
| 3,110,436 | 11/1963 | Wagner | 229/43 |
| 3,269,640 | 8/1966 | Armeson | 229/21 |
| 3,397,814 | 8/1968 | Zackheim | 220/306 |
| 3,411,692 | 11/1968 | Matthews | 229/21 |
| 3,566,946 | 3/1971 | MacDonald | 220/306 |
| 4,042,169 | 8/1977 | Burgdorf | 220/306 |

*Primary Examiner*—Davis T. Moorhead
*Attorney, Agent, or Firm*—Fitzgibbon, Roehrig, Greenawalt & Gilhooly

[57] ABSTRACT

A cover or closure arrangement for a product container of the type having a tubular body fabricated of paperboard or similar material which is characterized by a ring member formed of a semi-rigid plastic material having narrow top and side flanges and outer and inner annular grooves opening downwardly and inwardly, respectively, for securing the ring member on the top margin of the body sidewall and for removably securing a disc of paperboard, or the like, in closure forming relation in the ring member.

2 Claims, 5 Drawing Figures

CONTAINER CLOSURE ASSEMBLY

BACKGROUND OF THE INVENTION

This invention relates to packaging and is more particularly concerned with improvements in container structures which are adapted to be formed of paperboard or the like and which are particularly adapted for packaging certain types of products which are in a liquid, semi-liquid, or granular state and can be flowed into the open top of the container and subsequently dispensed therefrom.

In the ice cream manufacturing and distributing industry one method of handling the freshly made product, particularly for storage and distribution to ice cream parlors and similar outlets, has been to package the product in bulk containers which are of a size to accommodate relatively large quantities of the product, for example, ten gallons, and which are of tubular configuration so as to conveniently fit within freezers, or cold counters of more or less standard design, from which the product is dispensed. The tubular configuration of the containers has been found most desirable because it affords a number of advantages over other forms of containers in freezing and handling. The cylindrical containers employed have generally comprised a body member which is adapted to be fabricated of paperboard or similar sheet stock in initially collapsed condition and provided with edge or rim reinforcing and end closures adapted to seat thereon when the tubular body is opened up. In one form of container commonly used end closure structures have been provided which include a metal ring which is adapted to be seated on the rim of the tubular container and a closure disc of paperboard or similar relatively stiff sheet material, which is secured on the mouth of the body by the ring. The metal ring is angular in cross section and the closure disc is secured by the ring so that it may be torn out or separated from the ring and discarded when it is desired to open the container and remove the contents, for example, when it is dispensed in an ice cream parlor, leaving the ring as a reinforcing member on the rim of the opened container.

While the metal ring type closure has had extensive commerical use, it has obvious disadvantages in that it requires special machinery for manufacture and, when in use, it presents some hazards, since sharp edges may result in damage to the hands of the user. Efforts to provide a non-metallic closure have been generally unsuccessful heretofore for a number of reasons. It is a general object of the present invention to provide a closure arrangement for containers of the type described which may be fabricated of non-metallic material and which eliminates the objectional hazards inherent in the metal ring arrangements heretofore in use.

A more specific object of the invention is to provide a closure arrangement for containers of the type described which have a body fabricated from paperboard, or similar material, which arrangement affords sufficient rigidity to the rim of the container body, which may be securely positioned on the rim and which includes a readily removable and disposable insert in the form of a disc member of paperboard or the like.

A further object of the invention is to provide an end closure assembly for a container which is adapted for use in packaging a flowable product, such as ice cream, wherein the body is fabricated from paperboard, or similar material, and the closure assembly incudes a plastic ring member of a size and configuration to be securely seated on the rim of the container body and having an insert in the form of a removable and disposable disc of paperboard or similar material which is securely held in the ring member.

Another object of the invention is to provide an end closure assembly for a collapsible paperboard container body which is adapted for use in the packaging of bulk ice cream or other flowable product wherein the assembly comprises a ring member adapted to be securely seated on the rim of the container body, which is formed of a relatively rigid continuous plastic with a recess for seating therein a closure disc of relatively stiff paperboard, or the like, so that the disc is securely held in closure forming position and may be readily removed and discarded, with the ring member remaining on the body rim and reinforcing the same while the container is in use and the contents is dispensed.

To this end there is disclosed and claimed herein an arrangement for closing the open end of a tubular body of a container formed of paperboard or other relatively stiff material which is particularly adapted for use in packaging flowable product, such as ice cream, which closure comprises a rim reinforcing ring formed of a relatively rigid continuous plastic of generally angular cross section with a downwardly opening annular recess into which the rim of the container body is adapted to seat and an inwardly opening recess for receiving marginal portions of a closure disc of relatively stiff paperboard or the like.

The invention will be best understood with reference to the paperboard bulk ice cream container which is hereinafter described and illustrated in the accompanying drawings wherein:

DESCRIPTION OF THE PREFERRED EMBODIMENTS OF THE INVENTION

Figure 1:
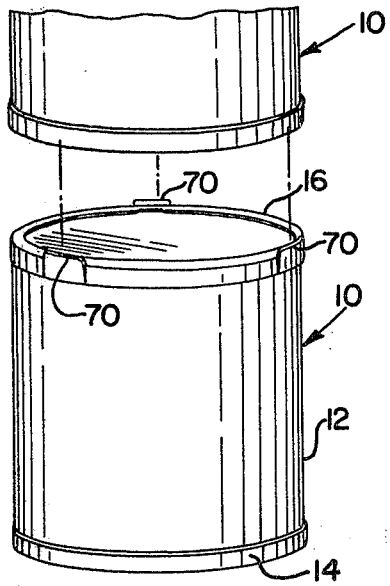
FIG. 1 is an exploded perspective view illustrating a tubular container which is adapted to be formed of paperboard and which is closed by a closure forming assembly having incorporated therein the principle features of the invention, with a bottom portion of a like container being shown so as to illustrate a stacking feature.
Figure 2:
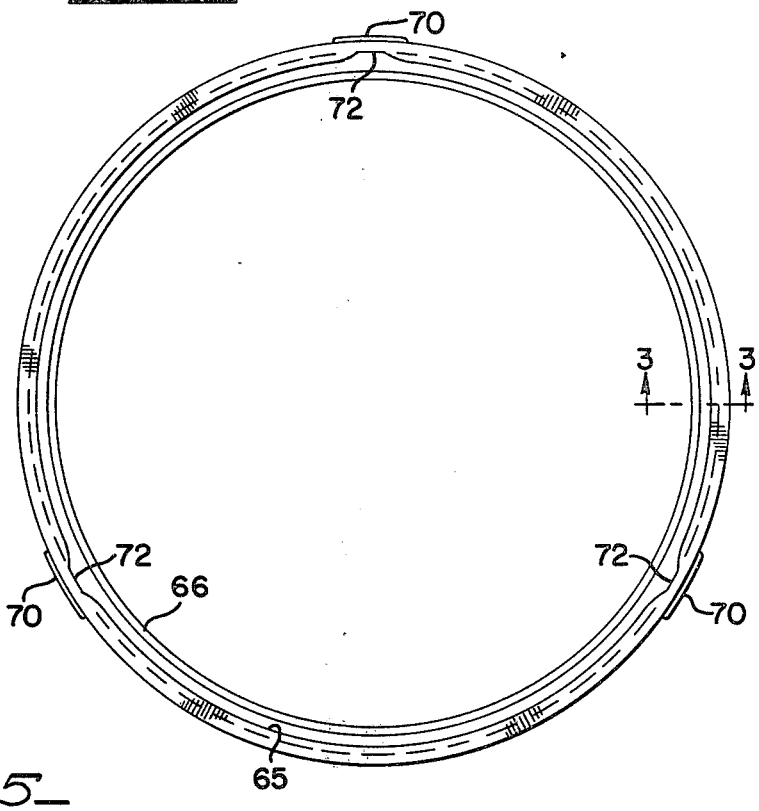
FIG. 2 is a top plan view, to an enlarged scale, of the closure assembly of FIG. 1, with the center closure disc omitted.
Figure 5:
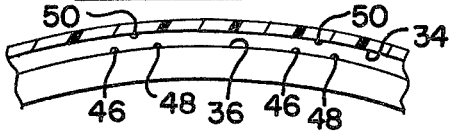
FIG. 5 is a sectional view taken on the line 5—5 of FIG. 3, to a reduced scale.

The container 10, which is illustrated in FIG. 1 in closed condition, is particularly adapted for use in the packaging of bulk ice cream, where the freshly made product, which is in a flowable state, is packaged and placed in a low temperature or freezing room or compartment, from which it is subsequently removed and delivered to an ice cream parlor or other area for dispensing, generally in relatively small quantities. The container 10 comprises a body member 12 in the form of an upright tube with a bottom closure 14 and a top closure assembly 16.

The tubular body member 12 may be formed initially in flattened condition, from paperboard of suitable grade, or similar sheet or tube forming material, and can be opened up into open tubular shape so as to receive a separate bottom closure 14 and a top closure 16. Alternatively, the body member may be a type having an automatic bottom, such as disclosed in U.S. Pat. No. 3,269,640, granted to E. L. Arneson Aug. 30, 1966, and No. 3,411,692, granted to E. G. Mathews Nov. 19, 1968. The sidewall has a narrow reinforcing band 18 at the top which is adhesively secured on the outer margin.

Figure 3:
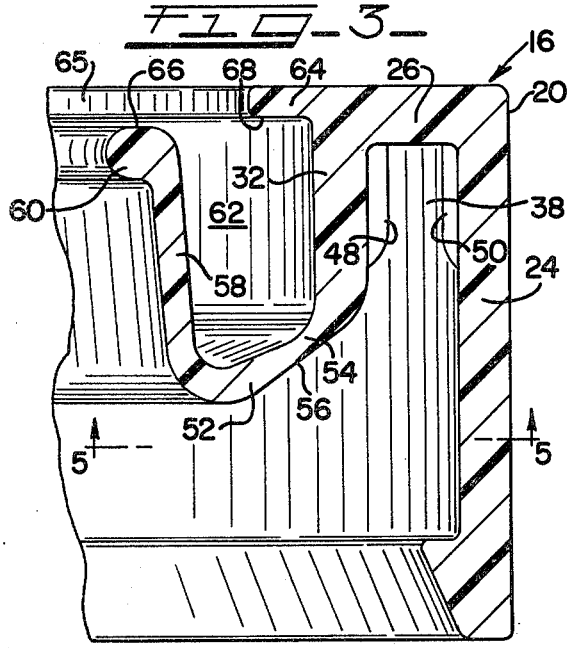
FIG. 3 is a cross sectional view, to an enlarged scale, taken on the line 3—3 of FIG. 2.
Figure 4:
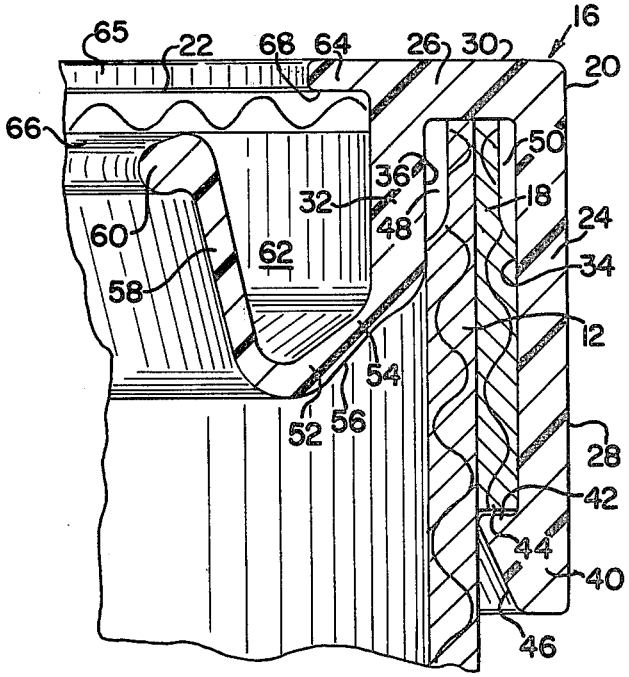
FIG. 4 is a cross sectional view similar to FIG. 3 with the closure assembly applied in closing relation to the top rim of a container body.

The closure or cover assembly 16 which is illustrated comprises a plastic ring member 20 and an associated disc member 22 which is adapted to be removably mounted in the ring member. The ring member 20 is formed of a continuous plastic material, preferably high density polyethylene. It is molded to provide the configuration shown, which includes an outer peripheral wall section 24 disposed in a vertical plane and a top wall or rim forming section 26, with outer faces 28 and 30 which are at right angles to each other as shown in FIG. 4. An annular inner wall section 32 is spaced from the inner face 34 of the outer wall section 24 a distance sufficient to receive between the outer wall face 34 and the outermost face 36 of the wall section 32, the thickness of the material constituting the marginal portion of the container body 12 and the reinforcing edge ring or band member 18. The annular groove or recess 38 (FIG. 3) thus formed between the wall sections 24 and 32 opens downwardly in the direction of the long axis of the container body member 12. The outermost wall section 24 is extended downwardly a sufficient distance to dispose the bottom edge below the bottom edge of the reinforcing band 18 with the bottom marginal portion 40 increased in thickness so as to provide an interior ledge formation 42 extending radially inwardly in the form of an abutment and facing upwardly so as to engage beneath the bottom edge 44 of the band 18. The annular face 46 of the thickened portion 40 is tapered downwardly and outwardly so as to facilitate application of the ring member 16. Securing ribs 46, 48 and 50, of relatively short length and extending parallel to each other are arranged in annularly spaced groups in the bottom of the groove 38 with the ribs 46, 48 in paired spaced relation on the wall surface 36 and the associated rib 50 on the surface 34 disposed intermediate the ribs 46, 48. These are designed to bite into the paperboard material and securely attach the ring member 16. The interior wall section 32 is extended and tapered or slanted inwardly so as to form an inwardly and downwardly inclined wall section or flange formation 52, with an area of reduced thickness at 54, so as to form a flexing area, and providing an inwardly and downwardly tapered or slanted outer face 56 for engaging the inner edge of the vertical wall of the container 12 so as to facilitate centering the ring relative to the container body opening when the ring 16 is applied.

The flange portion 52 extends to the bottom of a further flange formation 58 which extends upwardly and inwardly and terminates at its top edge in a bead formation 60 having generally curved or rounded faces. The flange formation 58 is spaced radially inwardly of the wall section 32 and provides the upwardly opening annular groove 62. The top horizontal wall 26 has an inner rim or flange portion 64 which overlies the outermost area of the groove 62 with the innermost edge 65 thereof defining an inside circular area of a lesser diameter than the diameter of the disc member 22. The ring member 16 is formed with the innermost flange 58 extending upwardly so that the topmost edge surface 66 (FIG. 3) is in a horizontal plane only slightly below the plane of the bottom face 68 of the top flange portion 64, the distance between the two planes being less than the thickness of the disc material thereby insuring a clamping action on the disc margin when the disc 22 is inserted in the ring member 20, as shown in FIG. 4. The groove 62 is of sufficient depth and the opening at the top is of sufficient width to enable the margin of the disc 22 to be depressed therein if desired so as to facilitate insertion and removal of the disc.

The ring member 16 is provided with annularly spaced upstanding lug members 70 which serve to locate or center a like container in proper position thereon for stacking as indicated in FIG. 1. The top wall extension flange 64 may be cut away as indicated at 72 opposite the lugs 70 and thereby expose the edge of the disc 22 for insertion of a tool to assist in removing the disc 22 when the container is to be opened.

While the form of the container which is illustrated and described is particularly designed for packaging ice cream, it will be understood that the closure arrangement is not limited to use with containers for such purpose, but is applicable to containers which are designed for packaging various other products.

What is claimed is:

1. A closure forming arrangement for an open end of a tubular container which comprises a ring member of semi-rigid plastic material having a rim forming section with peripheral surfaces in planes generally normal to each other and having an outboard peripheral recess opening in a direction generally normal to one surface of said rim section and extending generally parallel to the other surface which outboard recess is configured to receive a marginal portion of the container wall at the open end thereof with means therein to grip said wall portion when the latter is seated in said recess, and said ring member having a recess inboard of said peripheral recess which opens in a direction to receive therein marginal portions of a closure forming disc member of paperboard or similar material with inwardly spaced means for holding the disc against movement inwardly of the container, said outboard recess extending generally parallel with an outboard peripheral surface of said rim section and between outboard and inboard wall sections which extend generally parallel to each other and normal to a connecting wall section extending between corresponding ends of said outboard and inboard wall sections, said inboard recess being defined by the inboard surface of said inboard wall section, an overhanging extension of said connecting wall section and a wall section spaced from said overhanging extension of said wall section and extending inwardly of said inboard wall section, said wall section which extends inwardly of said inboard wall section having an area of reduced thickness intermediate its innermost and outermost edges which increases its flexibility and cooperates with the overhanging extension of said connecting wall section in clamping said closure forming disc in position in said recess.

2. A closure forming assembly for a tubular container body having a band formation on the marginal edge of the sidewall which presents, on the outboard face thereof, an abutment forming edge facing in the axial direction away from the end of the container, said closure forming assembly comprising a ring member of semi-rigid, continuous plastic material which has a peripheral outer wall section, a cooperating inner wall section spaced radially inwardly thereof and a connecting wall section in a plane normal to the plane of said outer and inner wall sections thereby providing a radially outer annular groove opening in an axial direction inwardly of said connecting wall section for receiving therein a marginal portion of said container sidewall and said band formation so as to secure said ring member on said container body in end closure forming relation, and said ring member having a radially inner annular groove which opens in an axial direction outwardly relative to the inwardly opening direction of said outer annular groove and inwardly in a radial direction for receiving therein marginal portions of a closure member which is in the form of a disc, said connecting wall section extending radially inwardly at its inboard margins so as to form a narrow flange which overlies outboard portions of said inner annular groove, an innermost axially directed wall constituting a flange formation which is radially spaced inwardly of said inner wall section, a flange formation extending in a radial plane and connecting the innermost edges of said axially directed innermost flange formation and said inner wall section, which connecting flange formation has an area of reduced thickness so as to form a flexing area, said innermost flange formation having a bead formation at its outermost edge with the terminal edge thereof in a radial plane spaced axially inwardly of the inner face of the portion of said connecting wall section which overlies said innermost groove a distance slightly less than the thickness of said closure disc so as to cooperate with the inwardly extending margin of said connecting wall section in clamping the marginal portions of said disc, and said bead formation being spaced inwardly of the inner edge of said connecting wall section a distance sufficient to permit the margins of said closure disc to be depressed into said innermost groove when seating said disc therein or removing said disc therefrom.

* * * * *